US011820537B2

(12) United States Patent
West

(10) Patent No.: US 11,820,537 B2
(45) Date of Patent: Nov. 21, 2023

(54) VARIABLE HEIGHT STRETCH WRAP MACHINE

(71) Applicant: Alpine Marketing International, Inc., Sandy, UT (US)

(72) Inventor: Ronald Roy West, Pleasant Grove, UT (US)

(73) Assignee: Alpine Marketing International, Inc., Sandy, UT (US)

( * ) Notice: Subject to any disclaimer, the term of this patent is extended or adjusted under 35 U.S.C. 154(b) by 55 days.

(21) Appl. No.: 16/872,332

(22) Filed: May 11, 2020

(65) Prior Publication Data

US 2020/0377244 A1 Dec. 3, 2020

Related U.S. Application Data

(63) Continuation-in-part of application No. 16/716,271, filed on Dec. 16, 2019, now abandoned, which is a continuation of application No. 16/529,635, filed on Aug. 1, 2019, now abandoned.

(60) Provisional application No. 62/713,201, filed on Aug. 1, 2018.

(51) Int. Cl.
*B65B 11/02* (2006.01)
*B65B 41/12* (2006.01)

(52) U.S. Cl.
CPC ..... *B65B 11/025* (2013.01); *B65B 41/12* (2013.01)

(58) Field of Classification Search
None
See application file for complete search history.

(56) References Cited

U.S. PATENT DOCUMENTS

| | | | | |
|---|---|---|---|---|
| 6,991,195 | B2 | 1/2006 | Mazzarolo | |
| 8,938,939 | B2 | 1/2015 | Roche | |
| 9,981,762 | B2 | 5/2018 | Chalmers | |
| 2005/0198922 | A1* | 9/2005 | Huson | B65B 11/025 53/399 |
| 2016/0200467 | A1* | 7/2016 | Cousins | B65B 11/025 53/556 |
| 2018/0257805 | A1 | 9/2018 | Baer | |

FOREIGN PATENT DOCUMENTS

| | | | |
|---|---|---|---|
| EP | 1950134 | A1 | 7/2008 |

* cited by examiner

*Primary Examiner* — Chinyere J Rushing-Tucker
(74) *Attorney, Agent, or Firm* — Wright Law Group, PLLC; Mark F. Wright

(57) ABSTRACT

A stretch wrap device. The stretch wrap device may include a base, a mast engaged with the base, such that the mast includes a plurality of adjoining mast sections. Each adjoining mast section having a plurality of side surfaces. Each adjoining mast section having at least one slot on at least one of the side surfaces and a connecting rod received within the slot of at least two immediately adjacent mast sections, the connecting rod being secured to each of the two immediately adjacent mast sections. The stretch wrap device may also include a stretch wrap holder slidably engaged with the mast such that the stretch wrap hold can slide along the mast.

48 Claims, 12 Drawing Sheets

VARIABLE HEIGHT STRETCH WRAP MACHINE

CROSS-REFERENCE TO RELATED APPLICATIONS

This application is a continuation-in-part of U.S. patent application Ser. No. 16/716,271, filed Dec. 16, 2019, which is a continuation of U.S. patent application Ser. No. 16/529,635 filed Aug. 1, 2019, which claims the benefit of U.S. Provisional Application No. 62/713,201, filed Aug. 1, 2018, which is hereby incorporated by reference herein in its entirety, including but not limited to those portions that specifically appear hereinafter, the incorporation by reference being made with the following exception: In the event that any portion of the above-referenced provisional application is inconsistent with this application, this application supersedes said above-referenced applications.

STATEMENT REGARDING FEDERALLY SPONSORED RESEARCH OR DEVELOPMENT

None.

BACKGROUND

1. The Field of the Present Disclosure

The present disclosure relates generally to a system and method to stretch wrap stacked materials on a pallet or platform that utilizes a mobile or rolling stand, sectional mast and a powered winch system for raising and lowering stretch wrap or other similar film which can allow a user to circumnavigate the pallet or platform, and simultaneously the stacked materials, while dispensing the stretch wrap around a combined vertical surface of the stacked materials.

2. Description of Related Art

There are numerous conventional systems that are designed to stretch wrap palletized or stated materials or cargo. There systems or devices vary from handheld dispensers such as the device 10 shown in FIG. 1, to portable, mobile stands 20 that utilize rollers 22 as shown in FIG. 2, to fixed placement machines 30 that can utilize a rotatable turntable 32 and mast, shown in FIG. 3.

FIG. 1 represents an inexpensive portable handheld wrapper that is manual in nature in which a person holds the roll and walks around the pallet and manually moves the roll up and down to wrap the goods.

U.S. Pat. No. 8,938,939, as shown in FIG. 2, discloses an apparatus for dispensing stretch wrap around loose materials for containment. It has similar characteristics to the invention proposed in the patent application. It has a rolling base that allows user to circumvent a pallet and dispense the wrap as the unit is moved and the stretch wrap roll can be raised and lowered mechanically by hand to secure the stretch wrap material from top to bottom of the bundle.

FIG. 3, U.S. Pat. No. 9,981,762, discloses a fixed turntable and mast where the pallet of materials is loaded on the turntable and the machine 30 automatically rotates the turntable. The turntable is located adjacent to a mast and the roll is raised and lowered on the mast to wrap the pallet as it is rotated by the turntable 32.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims. Any discussion of documents, acts, materials, devices, articles or the like which has been included in the present specification is not to be taken as an admission that any or all of these matters form part of the prior art base, or were common general knowledge in the field relevant to the present disclosure as it existed before the priority date of each claim of this application.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
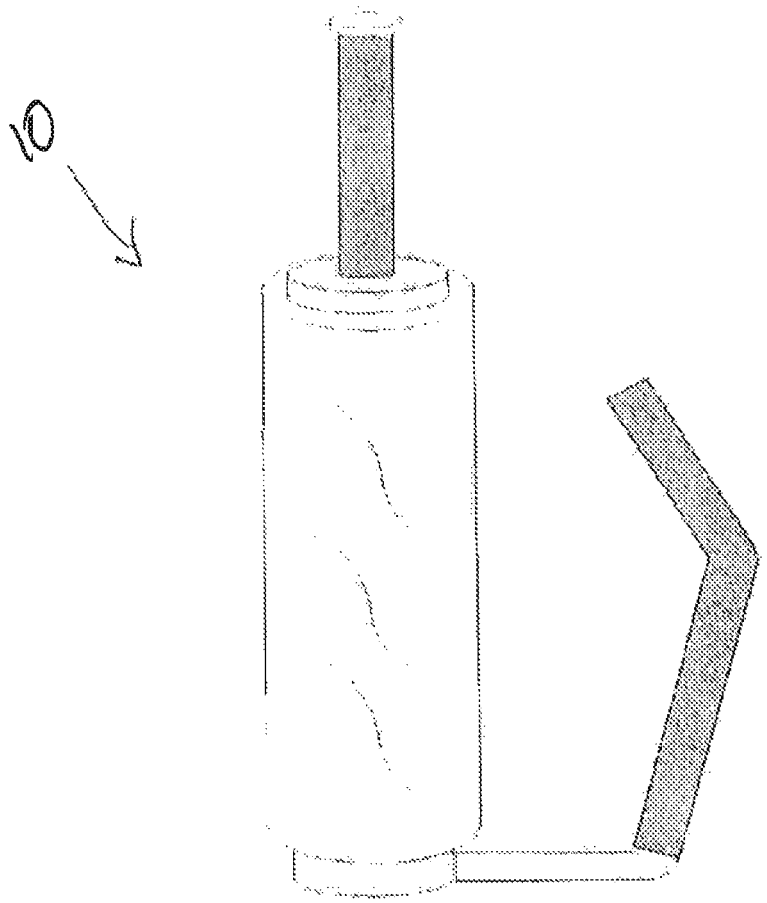
FIG. 1 is an illustration of a conventional hand-held wrapping device.
Figure 2:
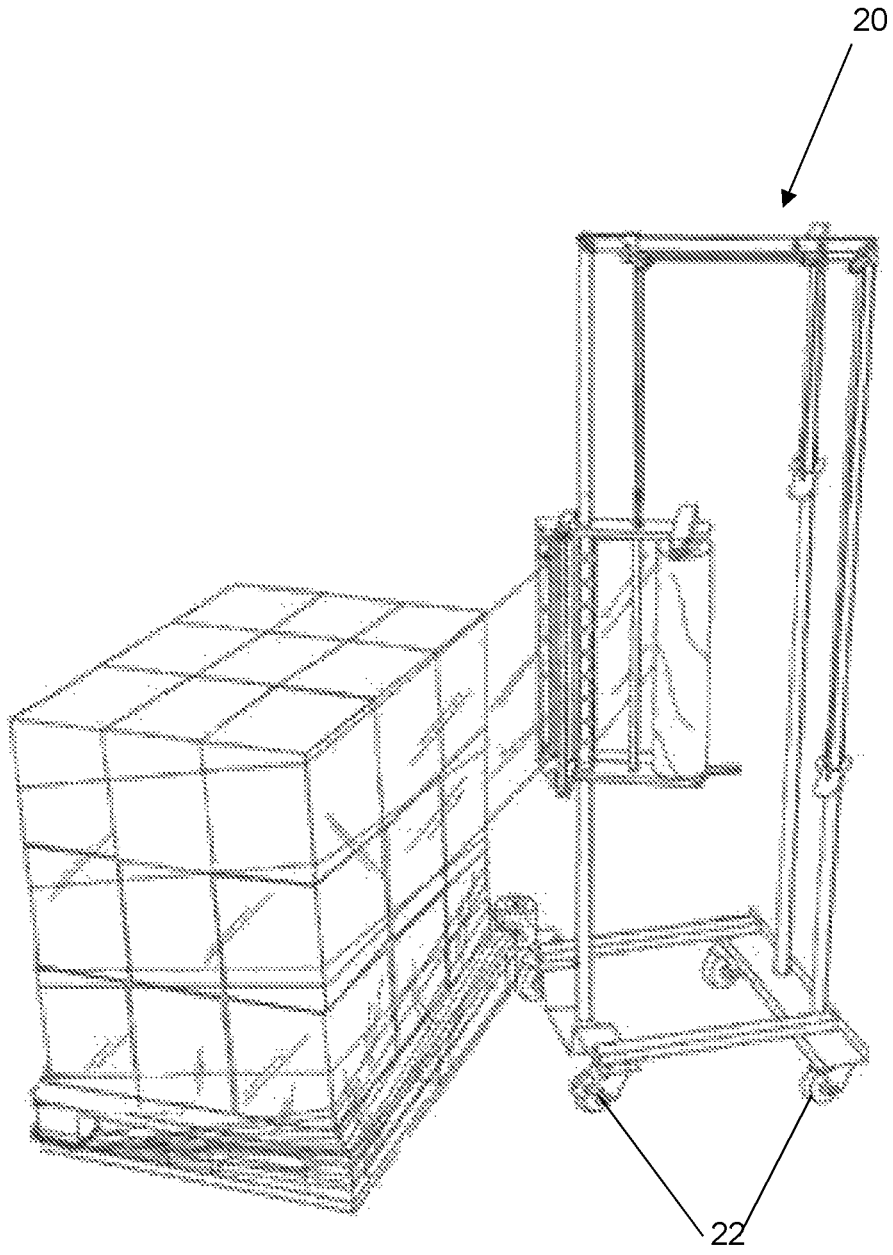
FIG. 2 is an illustration of another conventional wrapping device.
Figure 3:
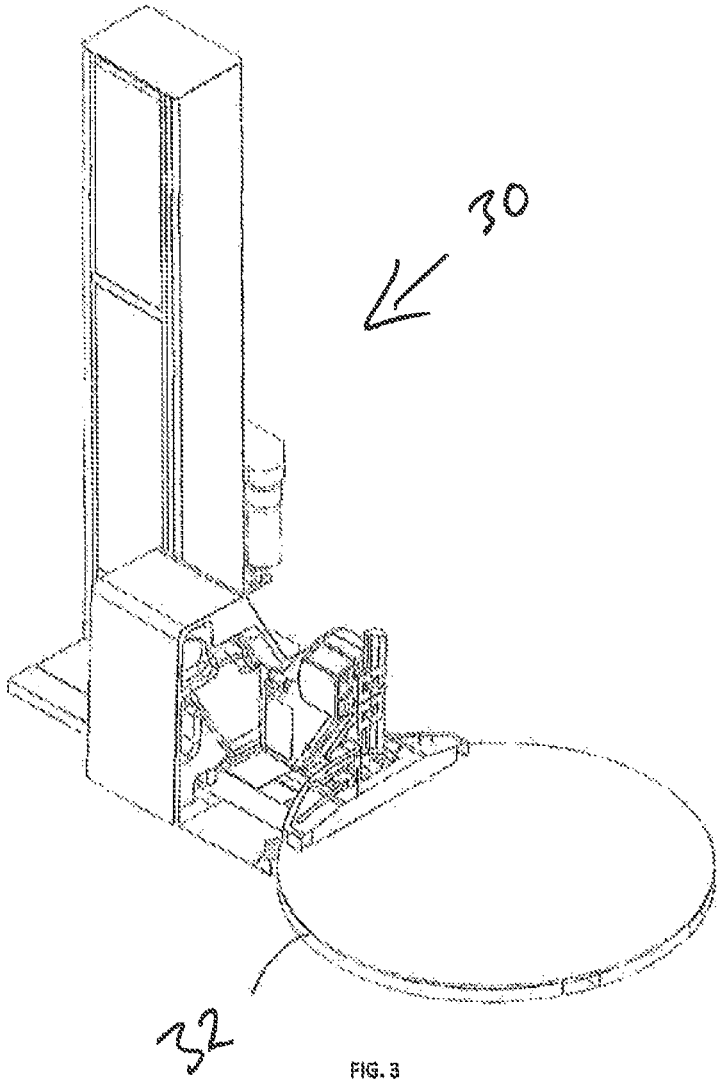
FIG. 3 is an illustration of a further conventional wrapping device.
Figure 4:
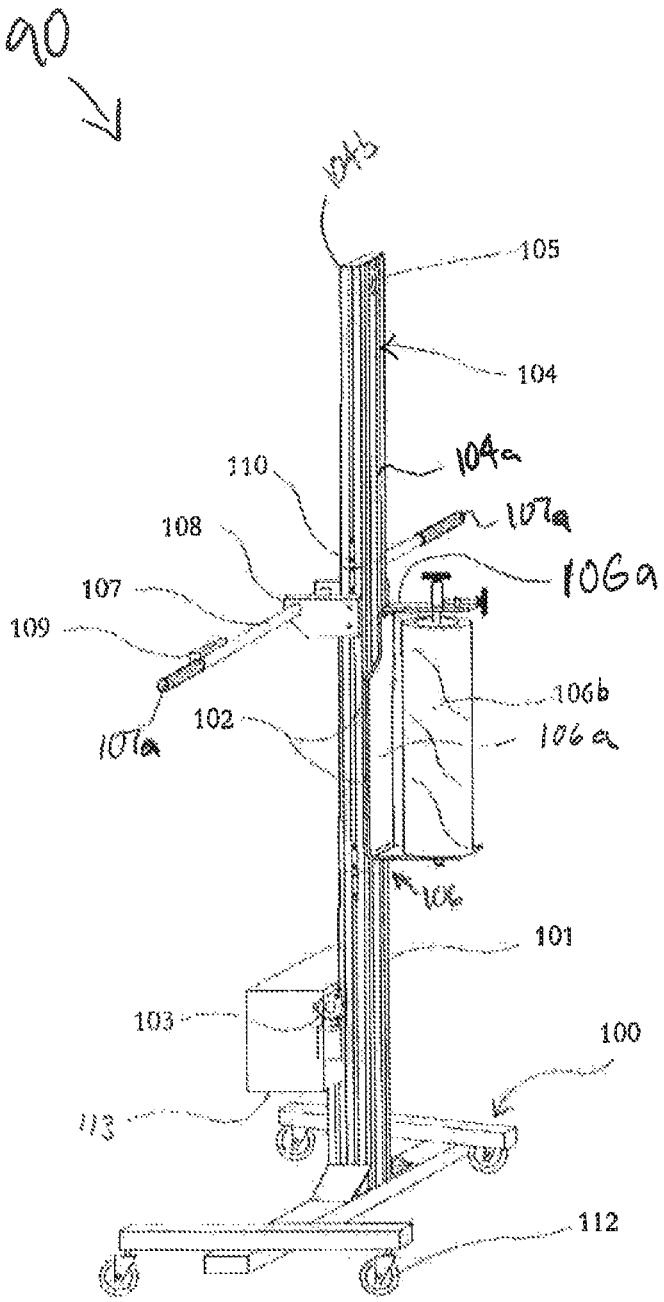
FIG. 4 is a perspective view of an wrapping device according to an embodiment of the present disclosure.
Figure 5:
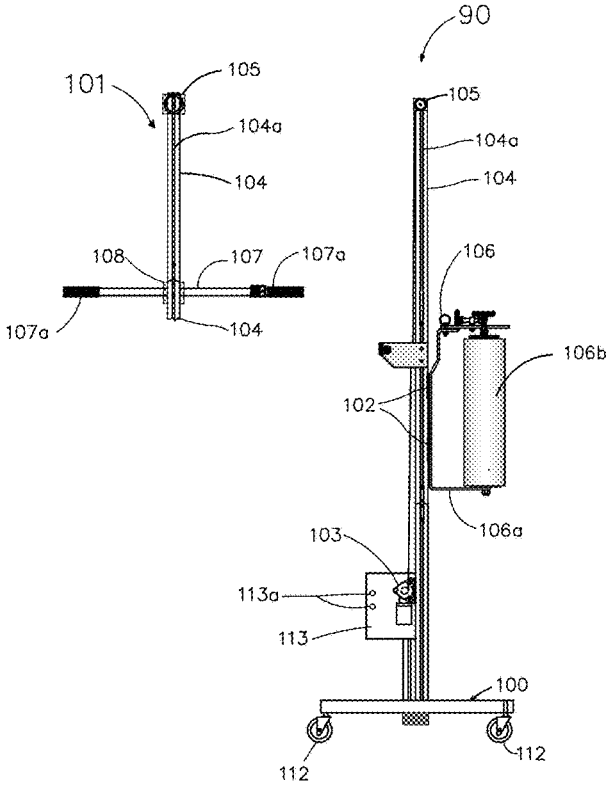
FIG. 5 is a side view of the wrapping device of FIG. 4, in an extended position.
Figure 6:
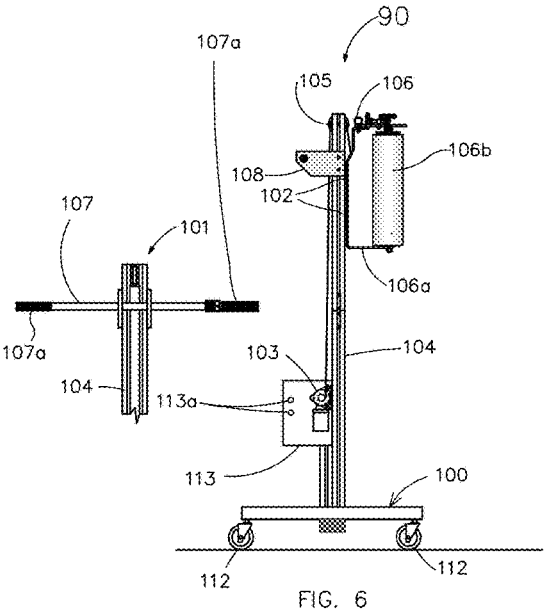
FIG. 6 is a side view of the wrapping device of FIG. 4, in a compressed position.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

The publications and other reference materials referred to herein to describe the background of the disclosure, and to provide additional detail regarding its practice, are hereby incorporated by reference herein in their entireties, with the following exception: In the event that any portion of said reference materials is inconsistent with this application, this application supercedes said reference materials. The reference materials discussed herein are provided solely for their disclosure prior to the filing date of the present application. Nothing herein is to be construed as a suggestion or admission that the inventors are not entitled to antedate such disclosure by virtue of prior disclosure, or to distinguish the present disclosure from the subject matter disclosed in the reference materials.

It must be noted that, as used in this specification and the appended claims, the singular forms "a," "an," and "the" include plural referents unless the context clearly dictates otherwise.

In describing and claiming the present disclosure, the following terminology will be used in accordance with the definitions set out below.

As used herein, the terms "comprising," "including," "containing," "characterized by," and grammatical equivalents thereof are inclusive or open-ended terms that do not exclude additional, unrecited elements or method steps.

As used herein, the phrase "consisting of" and grammatical equivalents thereof exclude any element, step, or ingredient not specified in the claim.

As used herein, the phrase "consisting essentially of" and grammatical equivalents thereof limit the scope of a claim to the specified materials or steps and those that do not materially affect the basic and novel characteristic or characteristics of the claimed disclosure.

The present disclosure includes apparatus, systems, and methods for stretch wrapping bundles of materials. In many cases material bundles to be wrapped may not exceed 48" in height, may or may not be greater than or less than 48" in height. By providing a stretch wrap device have a mast form from multiple sections, such as three mast sections, tow mast sections, or more, a user can elect to only assemble, for example, a lower section or sections of the mast to wrap shorter bundles, without the need to assemble the mast to a maximum height.

For example, if there are bundles exceeding 48", then additional mast sections can be used to facilitate wrapping taller bundles. Assembling the mast in its entirety may allow a user options for any desired height. Additionally, by manufacturing the mast in sections, the entire stretch wrap device may be portable and may be packaged and shipped in a significantly smaller box which may avoid oversize shipping charges.

The disclosed stretch wrap device 90 may include a rolling base 100 and swivel wheels 112 and have a single vertical or substantially vertical mast 101 comprised of rectangular aluminum extrusions with slots 104*a* formed on all four sides of the mast 101 to accommodate slides 102 that may allow the stretch wrap holder 106 to move up and down on the mast 101. Alternatively, the mast 101 may extend vertically or substantially vertically from a foundation or ground that is not portable or independent moveable.

Referring now to FIGS. 4-10, a first embodiment of the disclosed stretch wrap device 90 may include a vertical or substantially vertical mast 101, which may be provided in multiple mast sections 104 and may be secured to a base member 100 having wheels 112 allowing the unit to be transported around goods to be wrapped. Wheels 112 may be swivel-type wheels, enabling the wheels 112 to move freely over 360 degrees, to better facilitate movement of the stretch wrap device 90 over 360 degrees. Alternatively, the wheels 112 may be in a fixed or locked position. The wheels 112 can be of various diameters and widths to suit the environment in which the machine is used. Locking or fixed wheels 112 can be used when desired or necessary.

The mast 101 may be include formed via aluminum extrusion, although other materials or methods of manufacture may also be used if desired. The mast 101 can be formed having a substantially square or rectangular shape, having four substantially identically shaped sides, or having a substantially rectangular cross section.

The mast 101, including mast sections 104, may include vertical grooves, slots or openings 104*a*, along each of the four sides of the mast 101, and the slots 104*a* may run the entire length of the mast 101 and each mast section 104, enabling access to the slots 104*a* at each terminating end of each mast section 104.

Figure 7:
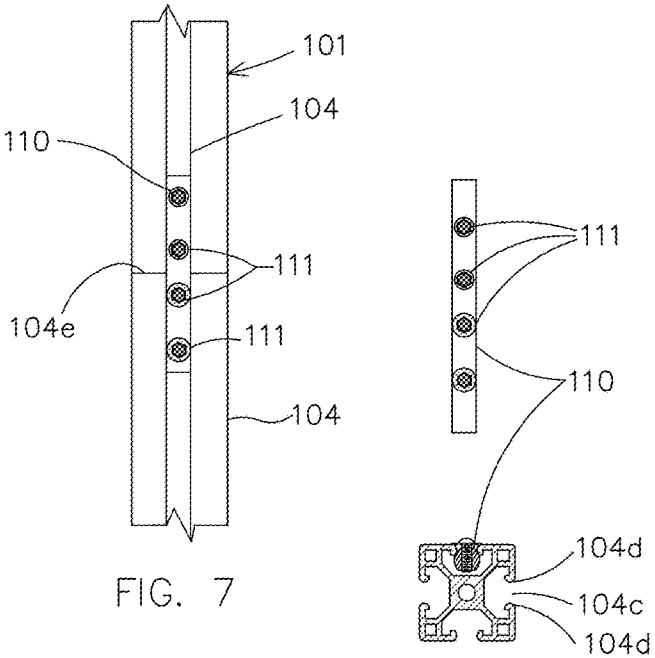
FIG. 7 is a front view of a portion of a mast of the wrapping device of FIG. 4.

As shown in FIG. 7, slots 104*a* may receive connecting rods 110, which may be used to join and secure abutting ends of adjacent mast sections 104 together and secure as butt joints 104*e*. Connecting rods 110 are used to secure sections at the butt joints 104*e* on the mast 101 allowing the mast 101 to be constructed at different heights by adding or eliminating mast sections 104.

Each of the slots 104*a*, on each of the four side of the mast 101 may be formed as the same size and geometric shape. Each of the slots 104*a* may also include a trough portion 104*c* which can receive the connecting rods 110 or slides 102 of the stretch wrap holder 106. Each slot 104*a* may also include opposing overhangs 104*d*. These overhangs 104*d* may extend substantially laterally over the trough portion 104*c*, partially enclosing the trough portion 104*c*. These overhangs 104*d* can prevent the connecting rods 110 or slides 102 from exiting the trough portion 104*c* in a perpendicular direction from the mast 101 or any direction not substantially parallel with the mast 101.

The connecting rods 110 may be formed in a substantially D-shape, having a curved or semi circular surface 110*a* and a flat or substantially flat surface 110*b*. Each connecting rod 110 may also include a plurality of through holes 110*c* extending entirely through the connecting rod 110. These through holes 110*c* may be threaded and formed to receive corresponding screw or bolts 111, or other desired fastener.

A user can assemble adjacent mast sections 104 by inserting a connecting rod 110 into the trough portion 104*c* at a terminating end of a first mast section 104, such that a portion of the connecting rod 110 is evenly received in the corresponding slot 104*a* and a portion of the connecting rod 110 extends beyond the terminating end of the mast section 104.

The user can then take a second mast section 104 and insert the portion of the connecting rod 110 extending from the first mast section 104, into the trough 104*c* of the second mast section 104 until the first and second mast sections abut one another as shown in FIG. 7.

Once immediately adjacent mast sections 104 are adjoined, a user can secure the connecting rod 110 to each of the immediately adjacent mast sections 104 by threading the bolts 111 through the connecting rod 110 until each of the bolts 111 contacts an interior surface of the mast section 104 inside the trough portion 104*c*. As the bolts 111 contact the mast section 104, continued threading of the bolts may force the connecting rod 110 in a direction away from the mast section 104 such that the curved portion 110*a* of the connecting rod 110 ultimately contacts the overhangs 104*d*. Due to the geometry of the curved portion 110*a* of the connecting rod 110, the connecting rod 110 can align the adjoined mast sections, and secure the adjoined mast sections against independent movement with respect to one another.

On a first side, such as a front surface 104*b*, the slots 104*a* may be used to receive the slides 102 that may be affixed to a stretch roll holder bracket 10 to slide vertically in both directions, both up and down.

Figure 11A:
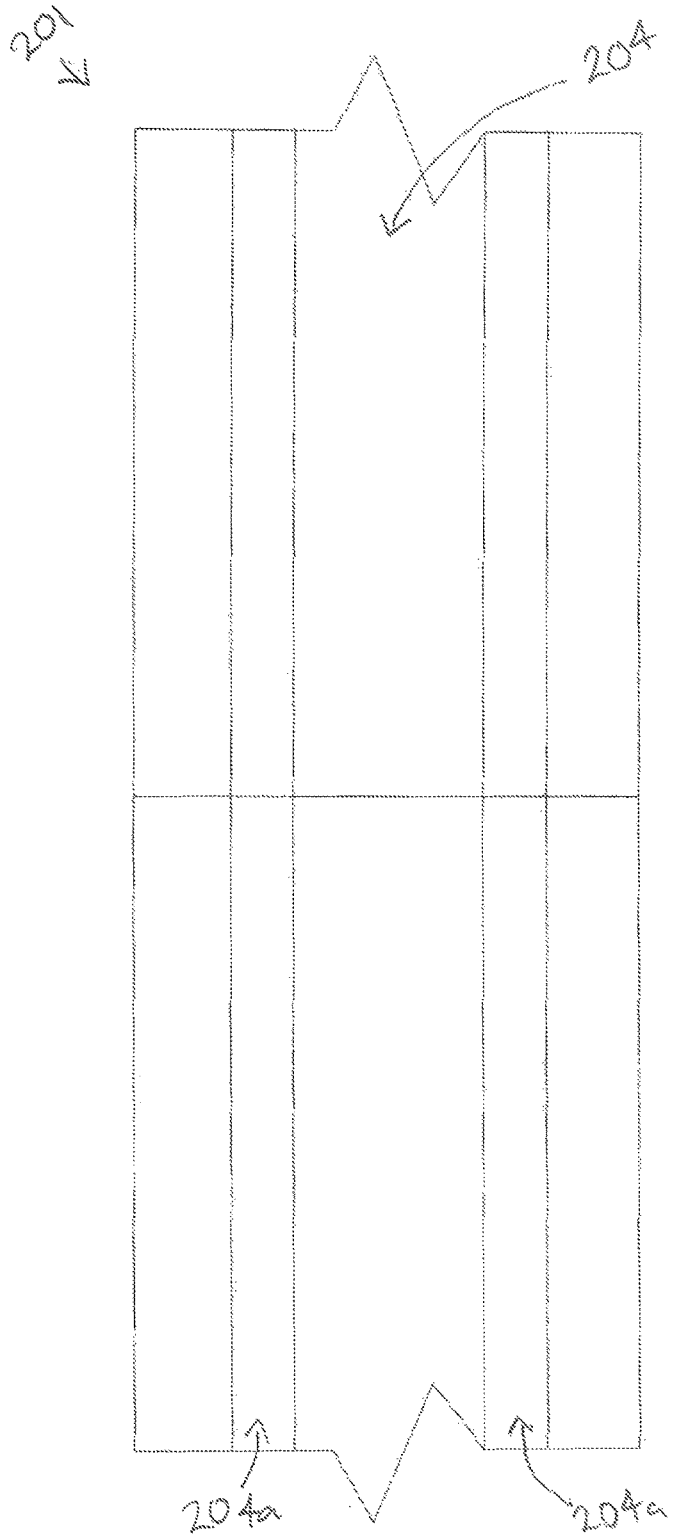
FIG. 11*a* is a front view of a mast another embodiment of a stretch wrap device.
Figure 11B:
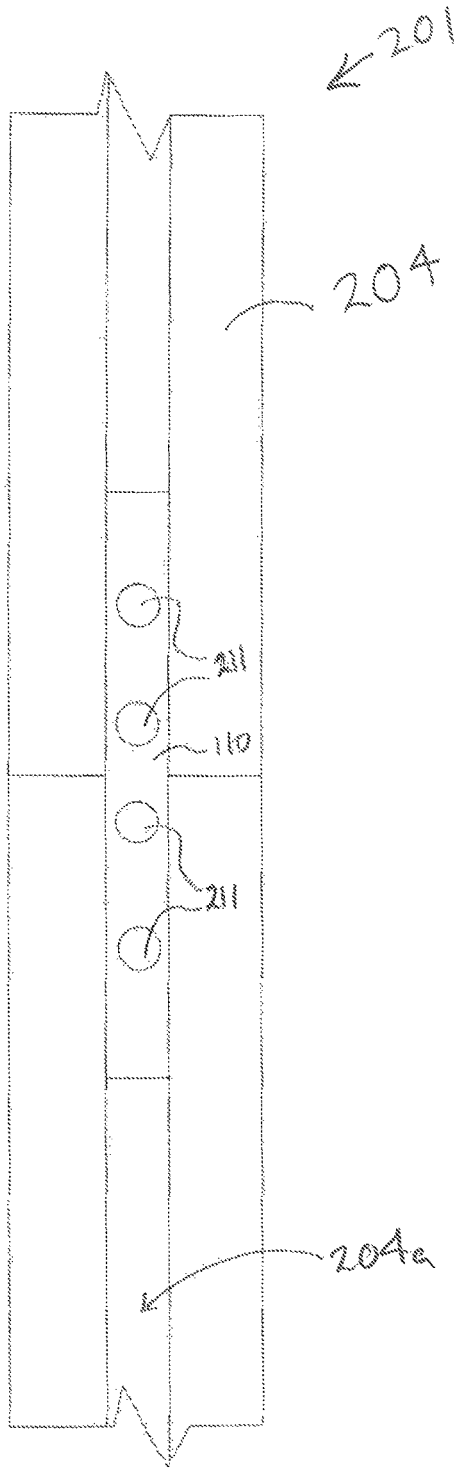
FIG. 11*b* is a side view of the mast of FIG. 11*a;*
Figure 12:
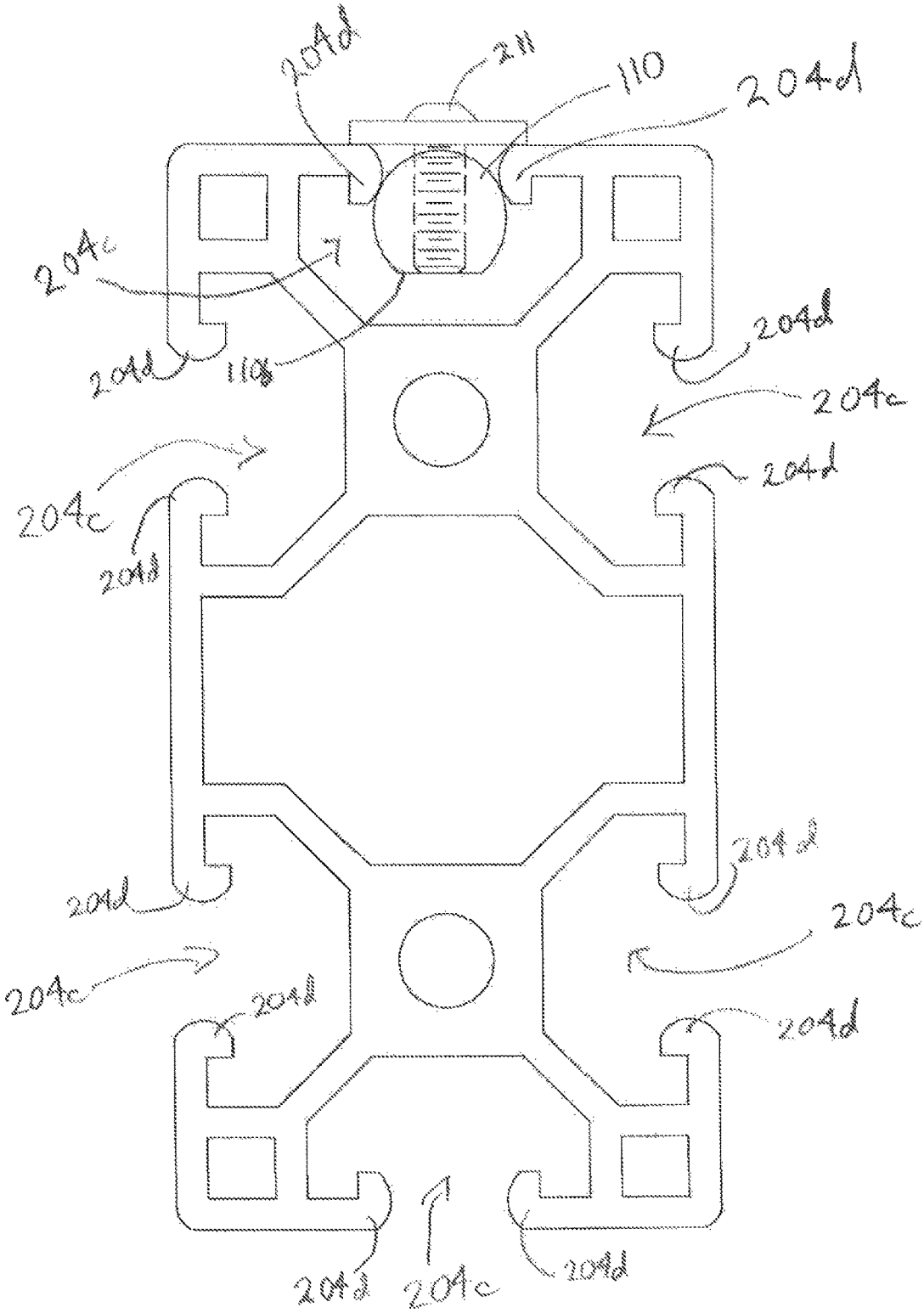
FIG. 12 is an end view of the mast of FIG. 11*a;*

As shown in FIGS. 11*a*-12, in another embodiment a mast 201, having mast sections 204, may include a plurality of slots 204*a* on a singe side surface. As with the previously disclosed mast 101, slots 204*a* may receive connecting rods 110, which may be used to join and secure abutting ends of adjacent mast sections 204 together and secure as butt joints. Connecting rods 110 may be used to secure immediately adjacent mast sections 204, as the butt joints, forming the mast 201 and allowing the mast 201 to be constructed at different desired heights by adding or eliminating mast sections 204.

Each of the slots 204*a*, on each of the four side of the mast 201 may be formed as the same size and geometric shape. Each of the slots 204*a* may also include a trough portion 204*c* which can receive the connecting rods 110 or slides 102 of the stretch wrap holder 106. Each slot 204*a* may also include opposing overhangs 204*d*. These overhangs 204*d* may extend substantially laterally over the trough portion 204*c*, partially enclosing the trough portion 204*c*. These overhangs 204*d* can prevent the connecting rods 110 or slides 102 from exiting the trough portion 204*c* in a perpendicular direction from the mast 201 or any direction not substantially parallel with the mast 201.

The immediately adjacent mast sections 204 may be adjoined using the connecting rods 110 in the same way that the connecting rods are used to adjoin immediately adjacent mast section 104 as discussed above.

A user can secure the connecting rod 110 to each of the immediately adjacent mast sections 204 by threading a plurality of bolts 211, or fasteners, through the connecting rod 110. Each of the bolts 211 may be a flange screw or each bolt may include a head that may be used to abut a corresponding washer, functioning similar to a flange screw. Alternatively, a flange screw could be used in place of a bolt and washer combination, yielding substantially the same mechanical and operational benefit. Alternatively, a user may thread a plurality of bolts, or fasteners, through the connecting rod 110 until each of the bolts contact an interior surface of the mast section 204 inside the trough portion 204*c*.

The flange portion of the bolt 211 may be positioned on an exterior surface of the mast section 204. As the flange portion of the bolts 211 contact the mast section 204, continued threading of the bolts 211 may force the connecting rod 110 in a direction away from the mast section 204 such that the curved portion 110*a* of the connecting rod 110 ultimately contacts the overhangs 204*d*. The overhangs 204*d* may then be sandwiched between the flanged portion of the bolts 211 and the curved portion 110*a* of the connecting rod 110.

Accordingly, the flanged portion of the bolts 211 can provide a force counter to the connecting rod 110, reducing potential damage or deformation of the overhangs 204*d* as the bolts 211 are tightened. As with the previously discussed embodiments, due to the geometry of the curved portion 110*a* of the connecting rod 110, the connecting rod 110 can align the adjoined mast sections, and secure the adjoined mast sections against independent movement with respect to one another.

Figure 8:
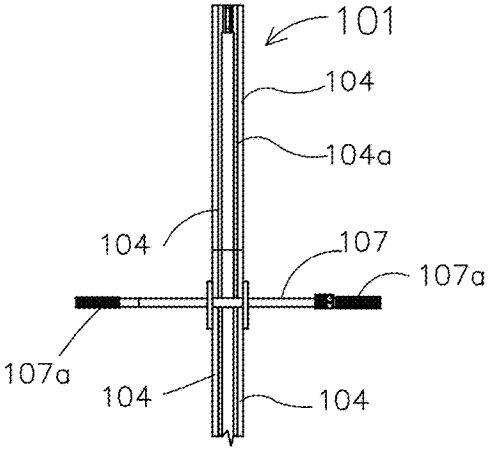
FIG. 8 is a front sectional view of a mast and handle bars of the wrapping device of FIG. 4.

As shown in FIG. 8, a three section handlebar 107 may be attached to the mast 101 to provide lateral control of the stretch wrap device 90 as it may be maneuvered around a product or bundle. The handlebar 107 may be fixedly attached or removably attached to the mast 101. For packaging purposes, the handlebar shown in FIG. 8 may be manufactured in three sections but may also be formed as a single piece, or any desired number of pieces, for example, two or more pieces. Two sections of equal length are joined in the middle by inserting each end into a larger diameter tube 114 that is placed between two brackets 108 that affix the handlebar to the mast 101.

The two sections of the handlebar 107 may then be inserted into the holes formed in the brackets and the center tube. Once the handlebar 107 is spaced evenly, set screws 108*a* may be installed into the brackets 108 and may make contact with the handlebar 107 and secure the handlebar 107 to the mast 101. Handlebar grips 107*a* may also be affixed to each end of the handlebar 107 to improve efficiency of use and comfort while using the stretch wrap device 90.

Additionally, by manufacturing the handbar 107 and the mast 101 into a plurality of sections, the entire stretch wrap device 90 may be more portable and may be packaged and shipped in a significantly smaller box, than a conventional stretch wrap device having a single-piece mast of similar size. For example, the disclosed stretch wrap device 90, having a mast 101 that may be disassembled into three sections and a handlebar 107 that may detachable and disassembled into a plurality of sections, such that all parts of the stretch wrap device 90, including the mast 101 and the handlebar 107 may be disassembled and fit together in a box or shipping container 12" wide, 24" long and 12" high. In other exemplary embodiments, the size of the box or shipping container may be smaller or larger depending the on the shipping needs or desires of a user, including avoiding or reducing shipping costs.

Attached to the mast 101 is a cable system that may include a winch 103 that may utilize a cable 103*a* and a pulley 105 affixed at the top, or terminal end, of the mast 101 to facilitate raising and lowering the stretch wrap holder 106 which includes the U-shaped bracket 106*a* that may be received within at least one of the slots 104*a* which secured the stretch wrap holder to the mast 101 while still enabling the stretch wrap holder 106 to slide vertically along the mast 101. The winch 103 may be electronically controlled by a remote switch 109 attached to the handlebar 107 that allows the operator to grasp hold of the stretch wrap device 90 and maneuver it around the products or bundles that are being wrapped. The handlebar 107 may be attached to the mast 101 assembly by brackets 108 that can be adjusted vertically along the mast 101 to suit an operator's ergonomic needs. The motor and winch 103 may be contained within a metal or plastic enclosure 113.

The winch 103, which may include an electric motor that can drive the rotation of the winch, may be used to raise and lower the stretch wrap holder bracket 106*a* along the face 104*b* of the mast 101. A remote switch 109 may be mounted to one side of the handlebar 107 and is used to control the motor 103. The handlebar 107 and switch 109 can be rotated to a comfortable or desired position for the user and then locked in place. Two switches, one for the left side of the handlebar 107 and the other on the right side of the handlebar 107 can be used instead of both up and down buttons being on a single switch. In this embodiment, a single wireless switch 109 is used.

An enclosure 113 may house the motor and winch 103, as well as, a corresponding motor battery and motor control unit. The enclosure 113 may also include recharging terminals 113*a* mounted to an exterior surface of the enclosure 113 enabling the electric motor to be recharged without accessing an interior of the enclosure 113.

The stretch wrap holder 106 may be secured to the mast 101 via the bracket 106*a*. The bracket 106*a* may also include slides 102 which may be attached to a rear side of the bracket 113. These slides 102 may be formed to fit inside and retained within the slots 104*a* on a desired face of the mast 101 and allow the bracket 106*a* to glide vertically along a face of the mast 101. A roller system can also be used to facilitate the vertical movement of the stretch wrap bracket 106*a*.

Figure 9A:
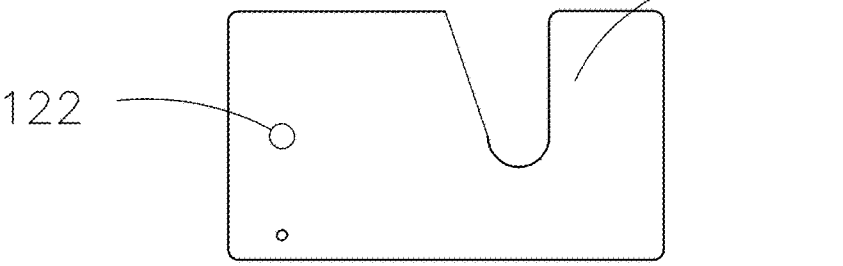
FIG. 9*a* is a top view of a swivel bracket of the wrapping device of FIG. 4.
Figure 9B:
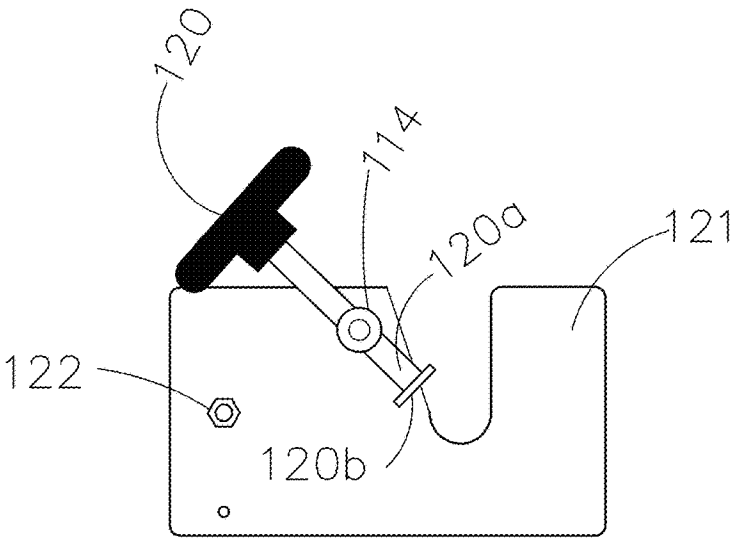
FIG. 9*b* is a top view of the swivel bracket of FIG. 9*a*, assembled with a knob locking mechanism.

FIGS. 9*a* and 9*b*, illustrate a swivel bracket 121 may be utilized to secure a top of the stretch wrap roll 106*b* once the roll 106*b* is installed onto the stretch wrap holder 106. The swivel bracket 121 may include a pivot pin 122 which is secured to the stretch wrap holder 106. The swivel bracket 121 may provide for ease of replacing used up stretch wrap rolls 106 by swiveling out of the way to allow a new roll to be dropped into position on the stretch roll holder 106. Once the roll is in place, the bracket 121 is then swiveled back in place over the stretch wrap roll 106*a*. A hitch pin 123 inserted in a through hole may prevent the bracket 106*a* from swiveling.

Figure 10:
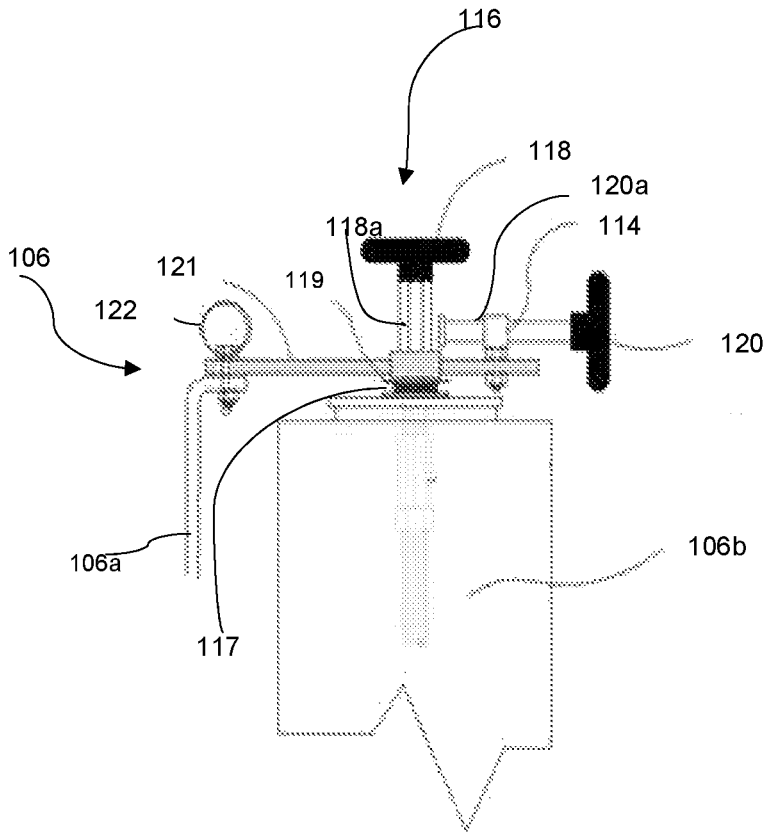
FIG. 10 is a partial side view of a roll assembly of the wrapping device of FIG. 4

As shown in FIG. 10, a tensioning system may be used to adjust the amount of stretch the film of the stretch wrap roll 106*b* may have as it is wound around a product or bundle. The tensioning system incorporates a compression type mechanism 116 that compresses against the top of the stretch wrap roll 106*b* with a downward force and allows for varying pressures to create desired tension on the stretch wrap roll 106*b* as it is unwound. The compression mechanism 116 may include any medium, that after being compressed, may return to its original shape after the force causing the compression is released, including, but not limited to, rubber, urethane, bearings, such as thrust bearings for example, and washers with a spring 117, installed to compress the spring 117 on a machined end of a threaded rod 118*a*. Positioned above the bearings and spring 117 is a knob 118 affixed to the end of the machined portion of the threaded rod 118*a*.

As the knob 118 is turned clockwise and the threaded rod 118*a* feeds into a threaded coupler 119 affixed to the end of another threaded rod that extends inside the stretch wrap roll 106*b* throughout its length. The tension increases as the knob 118 is tightened due to the spring 117 being compressed. Once the proper or desired tension is achieved, a bolt 120*a* with a blunt end and a knob 120 at the opposite end is turned against a flat surface on the threaded rod 118*a* thus locking it in position.

Figure 13A:
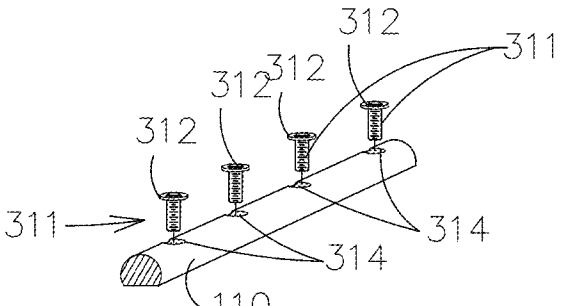
FIG. 13*a* is a perspective view of a connecting rod of another embodiment of a stretch wrap device.
Figure 13B:
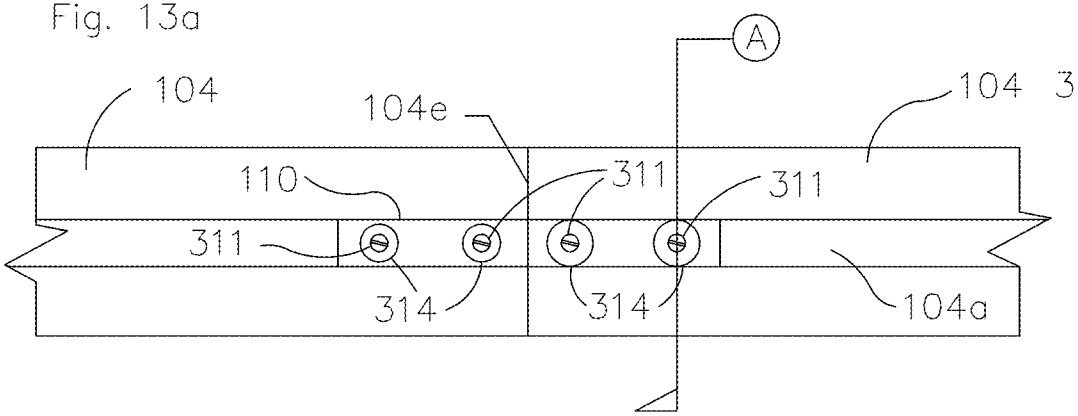
FIG. 13*b* is a side view the mast of FIG. 13*a;*
Figure 13C:
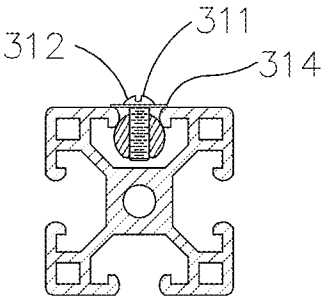
FIG. 13*c* is a cross-sectional view along plane A of the mast of FIG. 13*b;*
Figure 14B:
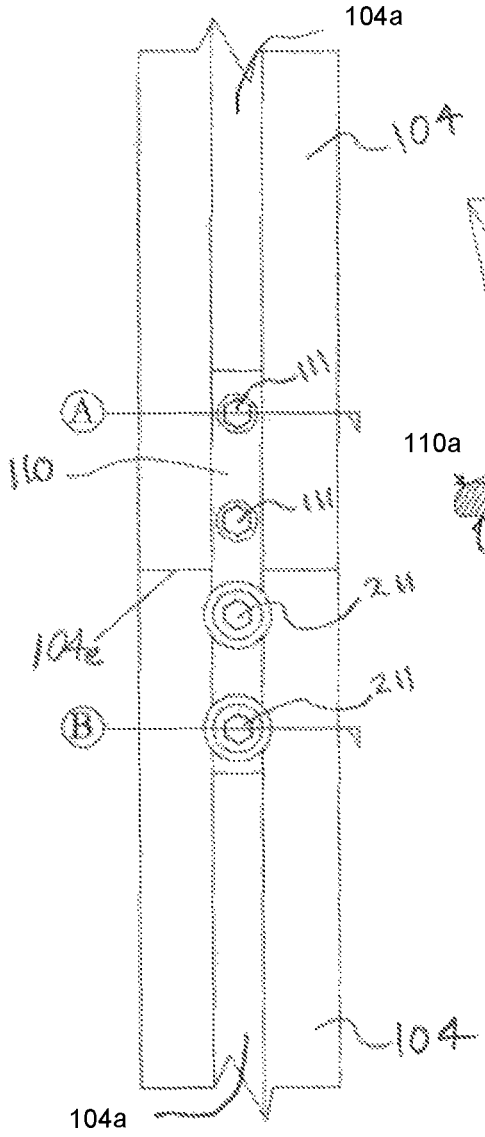
FIG. 14*b* is a side view the mast of FIG. 14*a;*
Figure 14A:
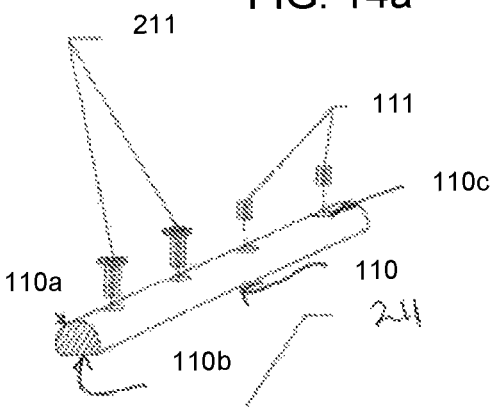
FIG. 14*a* is a perspective view of a connecting rod of another embodiment of a stretch wrap device.
Figure 14D:
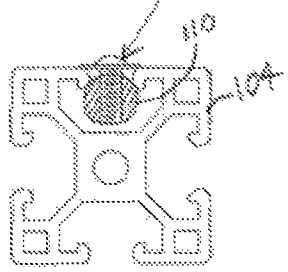
FIG. 14*d* is a cross-sectional view along plane B of the mast of FIG. 14*b*.
Figure 14C:
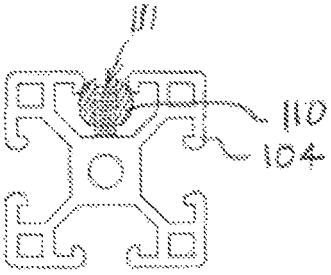
FIG. 14*c* is a cross-sectional view along plane A of the mast of FIG. 14*b*.

As shown in FIGS. 13*a*-13*c*, in another embodiment, once immediately adjacent mast sections 104 are adjoined, in the same manner discussed above, a user can secure the connecting rod 110 to each of the immediately adjacent mast sections 104 by threading a plurality of bolts 311, or fasteners, through the connecting rod 110 until each of the bolts 311 contact an interior surface of the mast section 104 inside the trough portion 104*c*. Each of the bolts 311 may include a head 312 that may be used to abut a corresponding washer 314. Alternatively, a flange screw could be used in place of each bolt 311 and washer 314 combination, yielding substantially the same mechanical and operational benefit.

The washer 314 may be positioned on an exterior surface of the mast section 104 and receive a corresponding bolt 311. As the bolts 311 contact the mast section 104, though the connecting rod 110, continued threading of the bolts 311 may force the connecting rod 110 in a direction away from the mast section 104 such that the curved portion 110*a* of the connecting rod 110 ultimately contacts the overhangs 104*d*. The overhangs 104*d* may then be sandwiched between the washer 314 and the curved portion 110*a* of the connecting rod 110.

Accordingly, the washer 314 can provide a force counter to the connecting rod 110, reducing potential damage or deformation of the overhangs 104*d* as the bolts 311 are tightened. As with the previously discussed embodiments, due to the geometry of the curved portion 110*a* of the connecting rod 110, the connecting rod 110 can align the adjoined mast sections, and secure the adjoined mast sections against independent movement with respect to one another.

As shown in FIGS. 14*a*-14*d*, in another embodiment, once immediately adjacent mast sections 104 are adjoined, in the same manner discussed above, a user can secure the connecting rod 110 to each of the immediately adjacent mast sections 104 by threading a plurality of set screw style bolts 111 and flange bolts 211, or fasteners, through the connecting rod 110, using the same methodology as discussed above with respect to bolts 111 and flange bolts 211.

In this alternative embodiment, flange bolts 211 may be used simultaneously with set screw style bolts 111. As shown in FIGS. 14*a*-14*d*, bolts 111 may be fastened to a first mast section 104 and the flange bolts 211 may be fastened to an adjacent mast section 104. In yet further embodiments, bolts 111 and flange bolts 211 may both be used on the same mast section 104, if desired, or in any other desired combination.

In a disclosed embodiment, a method of constructing a structural apparatus may include, providing a mast, wherein the mast is configured to extend in a substantially vertical direction from a foundation, wherein the mast includes a plurality of adjoining mast sections, each adjoining mast section having a plurality of side surfaces. Each adjoining mast section having at least one slot on at least one of the side surfaces, the slot of each mast section having a trough portion and a pair of overhangs that extend over the trough portion, partially enclosing the trough portion.

The method may further include: providing a connecting rod received within the slot of at least two immediately adjacent mast sections, wherein the connecting rod is secured to each of the two immediately adjacent mast sections, and wherein the connecting rod includes an outer surface having a curved portion and a flat portion, such that the curved portion contacts the pair of overhangs of each of the immediately adjacent mast sections.

The method may also include assembling the adjacent mast sections by inserting a portion, such as substantially one half, of the connecting rod into the trough portion at a terminating end of a first mast section, such that a portion, such as the left over substantially one half, of the connecting rod is received in the corresponding slot and wherein a portion of the connecting rod extends beyond the terminating end of the mast section.

The method may also include providing a second mast section and inserting a portion, such as substantially one half, of the connecting rod into the trough and extending from the first mast section, into a trough of the second mast section until the first and second mast sections abut one another.

The method may further include, securing the connecting rod to each of the immediately adjacent mast sections by threading bolts through the connecting rod until each of the bolts contacts an interior surface of the mast section inside the trough portion.

The method may further include, threading the bolts through the connecting rod such that the connecting rod may be forced in a direction away from the mast section, such that the curved portion of the connecting rod contacts the overhangs.

Another disclosed embodiment may include, a structural apparatus that may include, a mast, wherein the mast includes three mast sections, each mast section having a plurality of side surfaces an a plurality of slots. The structural apparatus may also include a connecting rod received within the slot of at least two immediately adjacent mast sections, wherein the connecting rod is secured to each of the two immediately adjacent mast sections. The structural apparatus may also include a handlebar removably attached to the mast.

The structural apparatus may also be configured to include the mast and the handlebar being disassembled and fit together in a box or shipping container 12" wide, 24" long and 12" high. The wheeled mast for example, may be between 48" and 72" tall, or taller, when fully assembled. The design as described above and illustrated in the drawings including two or more detachable and interconnectable, mast sections—three such mast sections—cooperate as part of the design whereby it is to be understood that some or all portions of the rolling base 100 are detachable and/or can be assembled and disassembled in pieces and whereby all other portions can be assembled and disassembled including the stretch wrap holder 106, handlebar 107, brackets 108, enclosure 113, such that all portions of a stretch wrap device 90 which, when assembled stands 48"-72" tall or taller (e.g. 68" tall or 76" tall or 80" tall), such that a 72" stretch wrap device 90 can together fit inside a box or shipping container that is 12" wide, 24" long, and 12" high. Box dimensions may vary, if future changes to the disclosed design are incorporated or if alternate box dimensions are desired.

Those having ordinary skill in the relevant art will appreciate the advantages provide by the features of the present disclosure.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment.

Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A structural apparatus comprising:

a base;

a mast engaged with the base, wherein the mast includes a plurality of adjoining mast sections;

each adjoining mast section having a plurality of side surfaces;

each adjoining mast section having at least one slot on at least one of the side surfaces;

a D-shaped connecting rod received within the slot of at least two immediately adjacent mast sections, wherein the D-shaped connecting rod is secured to each of the two immediately adjacent mast sections;

and wherein the D-shaped connecting rod includes an outer surface having a curved portion and a flat portion.

2. The structural apparatus of claim 1, further comprising:

a stretch wrap holder slidably engaged with the mast such that the stretch wrap holder can slide along the mast.

3. The structural apparatus of claim 2 further comprising a swivel bracket affixed to the stretch wrap holder.

4. The structural apparatus of claim 1, further comprising:

a handlebar secured to the mast.

5. The structural apparatus of claim 1, wherein the at least one slot on at least one of the side surfaces comprises a plurality of slots and wherein each of the plurality of slots comprises a trough portion and a pair of overhangs that extend over the trough portion, partially enclosing the trough portion.

6. The structural apparatus of claim 5, the curved portion contacts a pair of overhangs of each of the immediately adjacent mast sections.

7. The structural apparatus of claim 5, wherein the connecting rod is configured to receive a plurality of fasteners, wherein the plurality of fasteners extend through the D-shaped connecting rod and contact an interior surface of the trough.

8. The structural apparatus of claim 7, further comprises:

a plurality of washers, each washer receiving one of the plurality of fasteners, wherein each of the washers are positioned on an exterior surface of the mast.

9. The structural apparatus of claim 8, wherein each of the fasteners includes a head, wherein the head of each fastener abuts at least one of the plurality of washers.

10. The stretch wrap device of claim 1, further comprising:

a cable system secured to the mast, the cable system including:

a winch connected to a cable, wherein the cable extends from the winch to the stretch wrap holder.

11. A structural apparatus utilizing comprising:

a mast, wherein the mast is configured to extend in a substantially vertical direction from a foundation;

wherein the mast includes a plurality of adjoining mast sections;

each adjoining mast section having a plurality of side surfaces;

each adjoining mast section having at least one slot on at least one of the side surfaces;

the slot of each mast section having a trough portion and a pair of overhangs that extend over the trough portion, partially enclosing the trough portion;

a D-shaped connecting rod received within the slot of at least two immediately adjacent mast sections, wherein the D-shaped connecting rod is secured to each of the two immediately adjacent mast sections;

and wherein the D-shaped connecting rod includes an outer surface having a curved portion and a flat portion, such that the curved portion contacts the pair of overhangs of each of the immediately adjacent mast sections.

12. The structural apparatus of claim 11, further comprising:

a stretch wrap holder slidably engaged with the mast such that the stretch wrap holder can slide along the mast.

13. The structural apparatus of claim 11, further comprising:

a handlebar secured to the mast.

14. The structural apparatus of claim 11, the curved portion contacts a pair of overhangs of each of the immediately adjacent mast sections.

15. The structural apparatus of claim 14, wherein a position of the handlebar with respect to the mast is adjustable.

16. The structural apparatus of claim 15, wherein the position of the handlebar with respect to the mast is adjustable by releasing at least one fastener securing the handlebar to the mast.

17. The structural apparatus of claim 11, wherein the connecting rod is configured to receive a plurality of fasteners, wherein the plurality of fasteners extend through the connecting rod and contact an interior surface of the trough.

18. The structural apparatus of claim 17, further comprising: a plurality of washers, each washer receiving one of the plurality of fasteners, wherein each of the washers are positioned on an exterior surface of the mast.

19. The structural apparatus of claim 18, wherein each of the fasteners includes a head, wherein the head of each fastener abuts at least one of the plurality of washers.

20. The structural apparatus of claim 1, further comprising:

a cable system secured to the mast, the cable system including:

a winch connected to a cable, wherein the cable extends from the winch to the stretch wrap holder.

21. A stretch wrap device comprising:

a base;

a mast engaged with the base, wherein the mast includes a plurality of adjoining mast sections;

each adjoining mast section having a plurality of side surfaces;

each adjoining mast section having at least one slot on at least one of the side surfaces;

a D-shaped connecting rod received within the slot of at least two immediately adjacent mast sections, wherein the connecting rod is secured to each of the two immediately adjacent mast sections; and a stretch wrap holder slidably engaged with the mast such that the stretch wrap holder can slide along the mast.

22. The stretch wrap device of claim 21, wherein the at least one slot on at least one of the side surfaces comprises a plurality of slots and wherein each of the plurality of slots comprises a trough portion and a pair of overhangs that extend over the trough portion, partially enclosing the trough portion.

23. The stretch wrap device of claim 21, wherein the D-shaped connecting rod includes an outer surface having a curved portion and a flat portion.

24. The stretch wrap device of claim 23, wherein the curved portion contacts the pair of overhangs of each of the immediately adjacent mast sections.

25. The stretch wrap device of claim 24, further comprises:

a plurality of washers, each washer receiving one of the plurality of fasteners, wherein each of the washers are positioned on an exterior surface of the mast.

26. The stretch wrap device of claim 21, wherein the D-shaped connecting rod is configured to receive a plurality of fasteners, wherein the plurality of fasteners extend through the D-shaped connecting rod and contact an interior surface of the trough.

27. The stretch wrap device of claim 26, wherein each of the fasteners includes a head, wherein the head of each fastener abuts at least one of the plurality of washers.

28. The stretch wrap device of claim 21, further comprising:

a handlebar secured to the mast.

29. The stretch wrap device of claim 28, wherein a position of the handlebar with respect to the mast is adjustable.

30. The stretch wrap device of claim 28, wherein the position of the handlebar with respect to the mast is adjustable by releasing at least one fastener securing the handlebar to the mast.

31. The stretch wrap device of claim 21, further comprising:

a cable system secured to the mast, the cable system including:

a winch connected to a cable, wherein the cable extends from the winch to the stretch wrap holder.

32. A stretch wrap device comprising:

a base;

a mast engaged with the base, wherein the mast includes a plurality of adjoining mast sections;

each adjoining mast section having a plurality of side surfaces;

each adjoining mast section having a plurality of slots in at least one of the side surfaces;

each of the plurality of slots of each mast section having a trough portion and a pair of overhangs that extend over the trough portion, partially enclosing the trough portion;

a D-shaped connecting rod received within the slot of at least two immediately adjacent mast sections, wherein the connecting rod is secured to each of the two immediately adjacent mast sections, wherein the D-shaped connecting rod includes an outer surface having a curved portion and a flat portion, such that the curved portion contacts the pair of overhangs of each of the immediately adjacent mast sections; and a stretch wrap holder slidably engaged with the mast such that the stretch wrap holder can slide along the mast.

33. The stretch wrap device of claim 32, further comprising:

a handlebar secured to the mast.

34. The stretch wrap device of claim 32, wherein a position of the handlebar with respect to the mast is adjustable.

35. The stretch wrap device of claim 34, wherein the position of the handlebar with respect to the mast is adjustable by releasing at least one fastener securing the handlebar to the mast.

36. The stretch wrap device of claim 32, further comprising:

a cable system secured to the mast, the cable system including:

a winch connected to a cable, wherein the cable extends from the winch to the stretch wrap holder.

37. The stretch wrap device of claim 36, wherein the cable system also includes a pulley which receives the cable.

38. The stretch wrap device of claim 36, wherein the cable system also includes a motor operably connected to the winch to drive rotation of the winch.

39. The stretch wrap device of claim 38, wherein the motor and the winch are enclosed in an enclosure, the enclosure having re-charging terminals accessible on an exterior of the enclosure.

40. The stretch wrap device of claim 32, wherein the stretch wrap holder includes a bracket that is received in at least one of the slots on the mast and is slidably engaged with the mast such that the stretch wrap holder can slide along the mast while secure to the mast.

41. The stretch wrap device of claim 32, wherein the connecting rod is configured to receive a plurality of fasteners, wherein the plurality of fasteners extend through the D-shaped connecting rod and contact an interior surface of the trough.

42. The stretch wrap device of claim 32, further comprises:

a plurality of washers, each washer receiving one of the plurality of fasteners, wherein each of the washers are positioned on an exterior surface of the mast.

43. The stretch wrap device of claim 41, wherein each of the fasteners includes a head, wherein the head of each fastener abuts at least one of the plurality of washers.

44. The stretch wrap device of claim 31, further comprising:

a swivel bracket secure to stretch wrap holder, wherein the swivel bracket is engaged with a pivot pin which is also secured to the stretch wrap holder and is configured to enable the swivel bracket to pivot away from the stretch wrap holder.

45. The stretch wrap device of claim 31, wherein the plurality of mast sections includes three mast sections.

46. The structural apparatus of claim 21 further comprising a swivel bracket affixed to the stretch wrap holder.

47. The structural apparatus of claim 32 further comprising a swivel bracket affixed to the stretch wrap holder.

48. The stretch wrap device of claim 32 further comprising a cable system secured to the mast, the cable system comprising:

a winch connected to a cable, wherein the cable extends from the winch to the stretch wrap holder;

a pulley which receives the cable; and a motor operably connected to the winch to drive rotation of the winch;

wherein the motor and the winch are enclosed in an enclosure, the enclosure having re-charging terminals accessible on an exterior of the enclosure.

* * * * *